United States Patent [19]

Cherrington

[11] 4,401,170

[45] Aug. 30, 1983

[54] APPARATUS FOR DRILLING UNDERGROUND ARCUATE PATHS AND INSTALLING PRODUCTION CASINGS, CONDUITS, OR FLOW PIPES THEREIN

[75] Inventor: Martin D. Cherrington, Fair Oaks, Calif.

[73] Assignee: Reading & Bates Construction Co., Houston, Tex.

[21] Appl. No.: 303,892

[22] Filed: Sep. 21, 1981

Related U.S. Application Data

[62] Division of Ser. No. 77,960, Sep. 24, 1979, Pat. No. 4,319,648.

[51] Int. Cl.[3] ..... E21B 7/08; E21B 7/20; E21B 17/00; E21B 4/02

[52] U.S. Cl. ..... 175/73; 175/61; 175/103; 175/107

[58] Field of Search ..... 175/61, 73, 325, 94, 175/92, 107, 103, 45, 203, 162

[56] References Cited

U.S. PATENT DOCUMENTS

| | | | |
|---|---|---|---|
| 1,454,048 | 5/1923 | Esperson | 175/325 X |
| 1,900,163 | 3/1933 | Dana et al. | 175/61 X |
| 2,079,449 | 5/1937 | Haldeman | 175/325 X |
| 2,179,832 | 11/1939 | Smith | 175/61 X |
| 2,717,763 | 9/1955 | Bodine, Jr. | 175/107 X |
| 3,797,589 | 3/1974 | Kellner et al. | 175/94 |
| 3,799,277 | 3/1974 | Kellner | 175/94 |
| 3,999,901 | 12/1976 | Tschirky | 175/107 X |
| 4,040,494 | 8/1977 | Kellner | 175/45 |
| 4,040,495 | 8/1977 | Kellner et al. | 175/73 |
| 4,051,911 | 10/1977 | Cherrington | 175/107 |

FOREIGN PATENT DOCUMENTS

| | | | |
|---|---|---|---|
| 852620 | 9/1970 | Canada . | |
| 1005433 | 2/1977 | Canada . | |
| 636879 | 5/1950 | United Kingdom | 175/61 |

OTHER PUBLICATIONS

Paone, et al., "Horizontal Boring Technology: A State-of-the-Art Study", U.S. Dept of the Interior, Bureau of Mines, Information Circular 8392, 1968, pp. 51-56.

Williamson, T. N., "Evaluation of Horizontal Drilling Techniques in Coal Beds", Bureau of Mines, Oct., 1972, distributed by NTIS, U.S. Dept. of Commerce, pp. 33, 34.

Zaba, et al., *Practical Petroleum Engineers' Handbook,* Third Edition, Gulf Publishing Co., Houston, Texas, pp. 216-223, 230, 231.

*Primary Examiner*—Stephen J. Novosad

[57] ABSTRACT

A directional drill attached to a drill string having periodic concentric collars is advanced in an inverted arcuate path to form a pilot hole underneath an obstacle followed by a larger concentric washover pipe. When the washover pipe reaches the surface on the other side of the obstacle a first reamer is attached to the end of the washover pipe exiting the drilling path, a second reamer of smaller diameter than the first reamer is attached to the other end of the first reamer by means providing for some separation between the two reamers, and a production casing of smaller diameter than the second reamer is attached to the other end of the second reamer with a swivel. The remaining length of the first portion of casing is supported some distance above the ground on rollers located above and beyond the exit point of the pilot hole. The reamers are operated by rotating the washover pipe and simultaneously drawing the washover pipe through the pilot hole. As the reamers are drawn through the pilot hole the first reamer enlarges the hole to a diameter greater than that of the casing. Drilling mud pumped through the washover pipe exits at the reamers to entrain the dislodged earth and the second reamer compacts it to form a bushing around the sides of the enlarged hole to lubricate the passage of the casing. The reaming operation may be performed without the production casing attached to the reamers followed by a second reaming operation with the casing attached in order to complete the installation.

1 Claim, 9 Drawing Figures

APPARATUS FOR DRILLING UNDERGROUND ARCUATE PATHS AND INSTALLING PRODUCTION CASINGS, CONDUITS, OR FLOW PIPES THEREIN

CROSS REFERENCE TO RELATED APPLICATION

This application is a division of my prior application Ser. No. 77,960 filed Sept. 24, 1979, now U.S. Pat. No. 4,319,648, issued Mar. 16, 1982.

BACKGROUND OF THE INVENTION

The present invention relates to a method for drilling underground inverted arcuate paths and installing production casings, conduits, or flow pipes therein.

Techniques have recently been developed for installing production casings, conduit, or flow pipes beneath rivers and other surface obstacles without dredging the riverbed, digging a trench, or otherwise altering the obstacle. See, e.g. U.S. Pat. No. 3,878,903. Instead a pilot hole is first drilled from a position at or near the surface on one side of the obstacle to a position at or near ground level on the other side. As the pilot hole is being drilled a washover pipe of inside diameter larger than the outside diameter of the drill string is advanced behind the leading end of the drill string and surrounding it. See U.S. Pat. No. 4,003,440. Reaming apparatus is then pushed or drawn through the pilot hole to enlarge the hole to a larger diameter. The production casing is thrust into the hole immediately behind the reaming apparatus and follows it along the drilling path. See. U.S. Pat. Nos. 3,894,402; 4,043,136 and 4,091,631.

Prior methods of drilling the pilot hole have utilized sections of drill string which are of uniform external diameter. When joined together such sections produce a drill string of uniform external diameter having no external protrusions at the joints between the sections or elsewhere along the string. Such joints are relatively weak, and the entire drill string tends to frequently stick during the drilling of the pilot hole.

Existing methods of advancing the washover pipe around the drill string, such as that disclosed in U.S. Pat. No. 4,003,440, provide the leading end of the washover pipe with a cutting edge which enlarges the pilot hole to a diameter equal to that of the washover pipe. Since no provision is made for supplying drilling mud to the leading end of the advancing washover pipe to entrain the cuttings dislodged by the cutting edge, the cuttings accumulate at the leading end of the washover pipe and inhibit its advance.

Prior methods of reaming the pilot hole and installing the production casing have used a single reamer and required that powered means be provided to thrust the production casing into the hole. Prior attempts to draw the reaming apparatus or production casing through the hole with, for example, the drill string used in drilling the pilot hole, have resulted in the drill string knifing through the soil and the reaming apparatus or production casing not following the original drilling path. In these methods it is also necessary to frequently interrupt the installation process in order to join additional sections of the production casing to the trailing end of the casing.

SUMMARY OF THE INVENTION

The present invention provides apparatus and a method for installing production casings, conduits, flow pipes and the like underneath and spanning an obstacle such as a river. As in existing methods a directional drill attached to a drill string is advanced in an inverted arcuate path to form a pilot hole underneath the obstacle. A larger concentric washover pipe follows the advance of the drill at some distance behind the drill to form a concentric annulus about the drill string and enlarge the pilot hole.

The preferred drill string of the present invention is made up of sections having external upsets at each end, making each drill string section of slightly larger external diameter at each end than in the middle. When these sections are joined together a drill string is produced with integral concentric collars formed by the upsets at each joint between the sections. This produces a stronger connection at each joint and during the drilling of the pilot hole the collars help size the hole and prevent the drill string from sticking in the hole as frequently as in prior methods.

The leading end of the washover pipe is provided with cutting blades which enlarge the pilot hole to a diameter greater than that of the washover pipe. This produces an annulus between the enlarged pilot hole and the washover pipe. During the advance of the washover pipe drilling mud is supplied through the inner annulus between the washover pipe and the drill string to entrain the cuttings dislodged by the cutting blades and return them through the outer annulus between the enlarged pilot hole and the washover pipe. This prevents the cuttings from accumulating within the washover pipe at its leading end and inhibiting its advance.

In one embodiment of the invention, when both the drill string and the washover pipe reach the surface on the other side of the obstacle, a first reamer, preferably a flycutter reamer, of larger diameter than the production casing is attached to the end of the washover pipe where it exits the drill path; a second reamer, preferably a floating reamer, having a relatively smaller leading end and a larger trailing end of smaller diameter than the first reamer and larger diameter than the casing is attached to the other end of the flycutter reamer by means, such as a section of washover pipe, providing for some separation between the two reamers; and the production casing is attached to the other end of the second reamer with a swivel. The end of the casing attached to the swivel is closed to prevent the entry of mud and cuttings during the reaming and installation operation. Preferably the casing joints have been previously welded together into a casing portion and the joints inspected and coated for corrosion resistance, so that the casing is in only one, or more than a few, portions. This allows the casing to be installed in an almost continuous movement. The portions of the production casing may be supported in line with the pilot hole some distance above the ground on rollers placed beyond the exit point of the pilot hole.

During the reaming of the pilot hole and installation of the production casing the exit point of the pilot string may become the entry point of the reaming apparatus and production casing. The reaming apparatus is rotated, and drawn through the pilot hole, typically by the washover pipe, followed by the non-rotating production casing. As in existing methods, drilling mud is provided to exit at the first reamers and entrain the cuttings. Unlike existing methods, two reamer are used and drilling mud may additionally exit at the second reamer.

The mud supply system of the present invention is capable of supplying much more mud at a higher pressure than the supply systems of existing methods. This provides lubrication for the passage of the production casing and permits the reamers and production casing to be drawn through the hole without having the washover pipe knife into the soil and cause the reamers and production casing to leave the original drilling path.

As the reaming apparatus is drawn through the pilot hole the first reamer enlarges the hole to a diameter greater than that of the second reamer and the cuttings dislodged by the first reamer are entrained in the drilled mud. The separation provided between the first reamer and the second reamer which follows it permits the cuttings to separate within the drilling mud and produces a more accurate hole than other methods.

The smaller diameter second reamer forces the drilling mud and entrained cuttings into the annulus between itself and the sides of the enlarged hole to form a concentric ring of mud and cuttings around the interior of the enlarged hole while leaving a concentric opening within this ring for passage of the production casing. The ring of drilling mud and entrained cuttings acts as a bushing in the concentric annulus between the production casing and the hole to lubricate the advance of the even smaller diameter production casing. Since the leading end of the casing is closed, the mud and cuttings do not enter the casing.

As the non-rotating production casing is drawn along the drilling path behind the rotating reaming apparatus, the remaining length of the first portion of the production casing outside of the hole is drawn along the rollers supporting it towards the point where the casing enters the hole. That part of the casing which is between rollers advances towards the hole horizontally, and that part of the casing which is between the rollers nearest the hole and the entry point of the hole bends due to gravity towards the entry point, advancing at a downward angle and entering the hole. The weight of this downward-angled part of the casing helps crowd the casing into the hole and reduces the force required to draw the reaming apparatus and following casing through the hole.

Using the weight of part of the production casing to crowd the casing into the hole eliminates the need for powered means to thrust the casing into the hole behind the reamer as in existing methods. Furthermore, since the advancing casing is permitted to bend from its horizontal path along the rollers to its angle of entry into the hole over the entire distance from the rollers nearest the entry point to the entry point itself, the shear stress on the casing and the risk of casing failure are much less than they are when the casing is placed on the ground immediately in front of the hole and must bend into the hole over a relatively short distance.

This method of the present invention also permits joints of the production casing to be joined together into longer portions prior to the beginning of the reaming and casing installation process. This eliminates the need in existing methods to frequently interrupt the installation of the casing in order to join additional joints to the trailing end of the casing extending out of the entry point.

In an alternative embodiment of the invention the reaming operation may be performed without the production casing attached to the reaming apparatus, followed by a second reaming operation with the production casing attached in order to complete the installation. In this embodiment, in the first reaming operation washover pipe is attached to the trailing end of the second reamer to provide a means for drawing the reaming apparatus and production casing through the enlarged hole in the second reaming operation. In the second reaming operation the production casing is attached to the trailing end of the second reamer as before and the reaming and installation process proceeds as described above.

The novel features of the present invention, as well as further objects and advantages thereof, will be better understood from the following description and accompanying drawings in which preferred embodiments of the invention are ilustrated by way of example. It is to be expressly understood, however, that the description and drawings are only for the purpose of illustration and as an aid to understanding, and are not intended as a definition of the limits of the invention.

DESCRIPTION OF THE PREFERRED EMBODIMENTS

Figure 1:
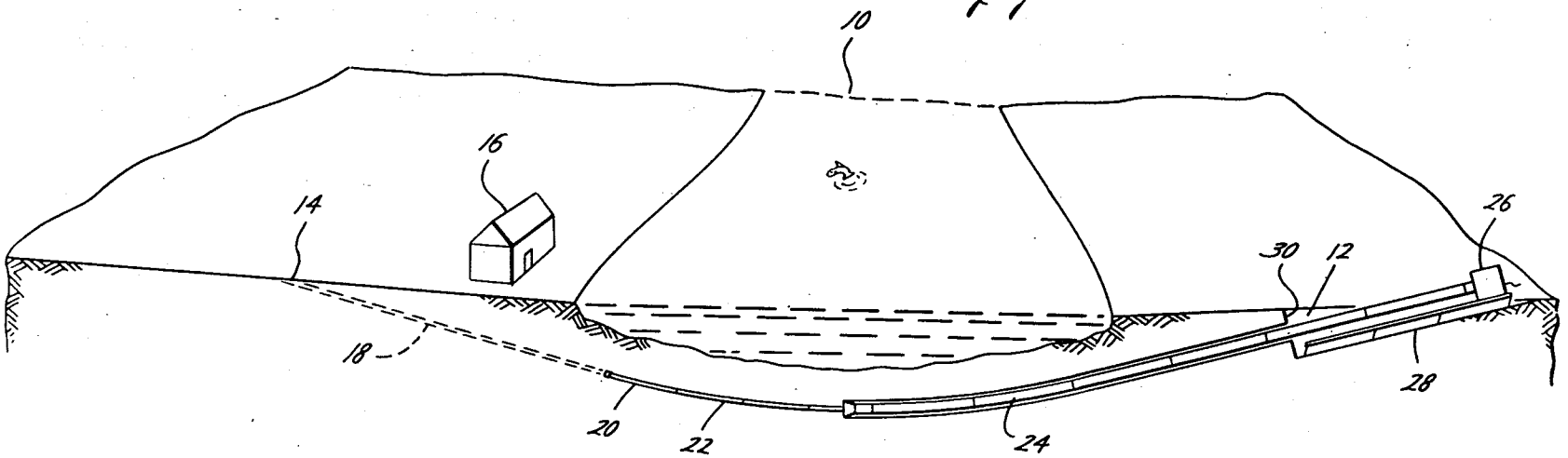
FIG. 1 is a cross-sectional elevation view illustrating the operation of the present invention in drilling a pilot hole along an underground inverted arcuate path under an obstacle.

The first operation of the present invention is illustrated generally in FIG. 1. In the situation depicted in FIG. 1, it is desired to traverse a water course 10, drilling from a first position 12 on the surface of the ground at one side of the water course to a second position 14 beyond a structure 16 at the other side. The desired is illustrated generally by dashed line 18, and can comprise either a constant radius arc or a path of complex curvature. A pilot hole is drilled along path 18 by a directional drill 20 powered by mud pumped through a trailing drill string 22 which extends through the drilled hole and exits at position 12. Directional drill 20 can be controlled according to the principles set forth in U.S. Pat. No. 3,878,903 for "Apparatus and Process for Drilling Underground Arcuate Paths." Other directional drilling techniques could be used as well.

As stated in U.S. Pat. No. 3,878,903:

"Traditional well drilling methods rely on the weight of the pendant drill string to achieve a substantially vertical hole. When an angular bend in the hole was desired, it was formerly the practice to lower a whip stock shim into the bottom of the hole which forced the drill off at an angle. Later methods utilize a self-powered drill which has a drill stem slightly angularly inclined with respect to the drill string. The problem with both of these methods is that the entire drill string must be removed from the hole, either to lower the whip stock or to mount the inclined drill. After the angle has been made, the entire drill string must be withdrawn again to remove either the whip stock or the inclined drill. This is extremely time consuming and inefficient since drill strings may be many thousands of feet in length. Furthermore, these methods provide no means for controlling the bend along its length other than removing and replacing the drill string whenever a change in angle is desired. Hence these methods are unacceptable for drilling controlled arcuate paths and can only be used for intermittent bends and/or constant radius turns.

"Techniques have been developed for drilling holes along a substantially linear horizontal path for placing telephone lines under streets and the like. However, these methods employ drills which proceed in a straight line, and to achieve an arcuate path, a pothole must be dug and the drill manually redirected. Such a method is often acceptable in traversing obstructions such as a road, but cannot be used for traversing a water course because the required potholes cannot be dug.

"The present invention provides an apparatus and process for drilling an inverted underground arcuate path. A drill rig having an acute angle of attack from the horizontal is placed interiorly of a pit where it enters the ground typically normal to the sidewall of the pit. A drill string powering a motorized drill is urged angularly downwardly into the ground by the drill rig. The drill at the drilling end of the drill string has imparted thereto an angle usually in the range of 1°–10° but possibly larger. As the drill string is urged into the ground and the drill is angularly aligned with respect to the string, an inverted arcuate path is bored by the drill so as to enter the ground downwardly and angularly at an entrance point and to exit the ground upwardly and angularly to an exit point with an inverted arcuate path therebetween. Parameters for controlling the arcuate path without withdrawing of the drill string to change drills or drill alignment are disclosed. Specifically, by slowing drill speed, increasing thrust on the drill string, and/or aligning the angularity of the drill to vector upwardly, the radius of curvature of the drill path can be decreased. Conversely, by increasing rotational drill speed, decreasing thrust on the drill string, or aligning the bend of the drill string to vector horizontally or downwardly, the radius of curvature of the inverted arcuate path can be increased.

"The present invention provides means for controlling the course of the inverted underground arcuate hole as it is being drilled. The following parameters are utilized: thrust on the drill string, speed of the drill rotors, volume of drilling mud passed to the drill, and azimuth of the inclined drill bit. By manipulating these parameters, the pitch of the drill bit as it travels is controllable to allow the path of the drill bit to be selectively varied as the hole is being drilled. This allows for continuous drilling of the hole from the entrance to the exit, and eliminates the necessity for removing and replacing the drill bit or other apparatus, greatly reducing the time and expense required to drill the hole.

Figure 2:
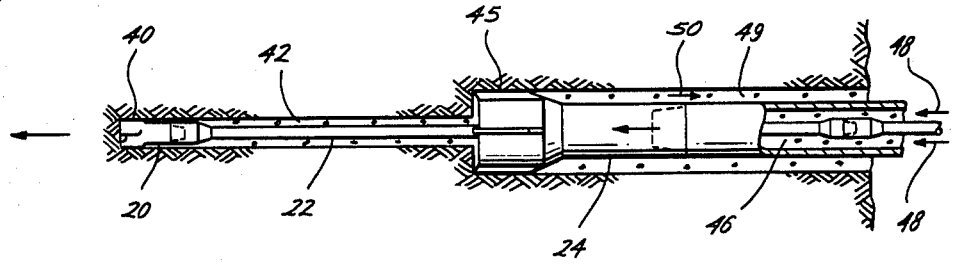
FIG. 2 is an elevation view of the leading end of the drilling apparatus illustrated in FIG. 1.

"The inclined drill rig apparatus 24 of the present invention is illustrated in more detail by way of reference to FIG. 2. Apparatus 24 includes ramp 30 mounted to the ground 32 in a pit 34.

"A power source 40 rides along ramp 30 on wheels 42. Movement of power source 40 along the ramp is controlled by the use of line 44 which dead ends at the extremities of the ramp, but which wraps around a powered winch 46 on power source 40. Power source 40 is usually an internal combustion engine having a plurality of power take-off attachments, but a wide variety of power sources could be employed. Power source 40 is utilized to thrust the drill string 48 angularly downwardly into ground 50 as illustrated by arrow 52 by driving winch 46. Controls are provided for winch 46 to control the forward thrust on drill string 48. Drill string 48 comprises a plurality of drilling pipes as known in the oil well drilling art, and in fact, standard oil well drilling materials are used to form the drill string. In the present invention, drill string 49 ordinarily does not rotate to operate the drill, but is rotatable in azimuth about its axis to control the drill head as will hereinafter be illustrated. Hence, power source 40 is capable of providing selective rotational control over the azimuth of drill string 48 as well as thrusting the drill string into the ground by means of winch 46.

"Power source 40 is also adapted to force drilling mud through the hollow interior of drill string 48 to power the drill head and remove loosened particles from the drilled hole.

Figure 3:
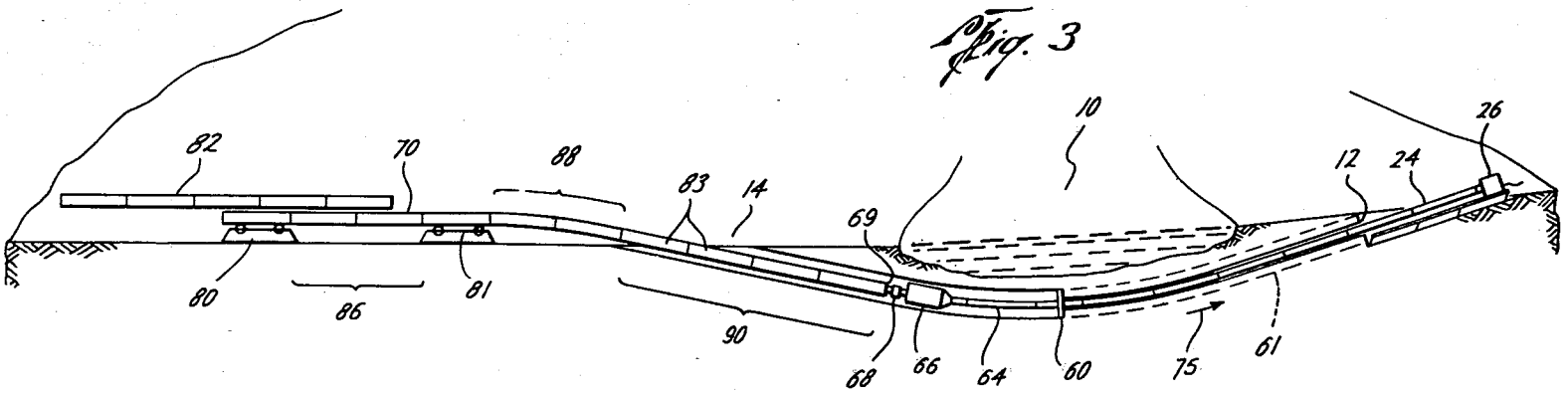
FIG. 3 is a cross-sectional elevation view illustrating the operation of the present invention in reaming the pilot hole and installing a production casing along the reamed hole.

"FIG. 3 illustrates the attachment of a drill head casing 70 to the end 72 of drill string 48 opposite power source 40. Drill head 70 is of the type known in the art wherein the drilling mud forced through drill string 49 is used to power the drill. Drill head 70 is of the type which has an angular bend 74 with respect to the axis of drill string 48 so that the drill bit portion 76 of drill head 70 is angularly inclined as illustrated. The angular bend 74 of drill 70 can be varied, and the inclinations of from 1° to 5° are well known in the art. However, it has been found advantageous in the present invention to increase the angular bend at least to 10° and possibly greater in many applications to achieve the desired control over its movement. The angular bend 74 shown in the figures is probably too large for most applications, however, and is probably an exaggeration. The upper bound of this parameter has yet to be determined. The cutting portion 78 of drill bit 76 is thus angled significantly with respect to drill string 48. Cutting tip 78 is of the type known in the art and usually has three rotors each having a plurality of cutting teeth.

"A further control feature provided by the apparatus of the present invention is that the forcing of drilling mud through the interior of drill string 48 by power source 40 is controllable. Increasing the force on the drilling mud has two effects on the drill: first, the speed of the drill rotors on tip portion 78 is increased; and second, the volume of drilling mud expelled through tip 78 of drill head 70 is increased. The increase in the flow of drilling mud will result in increasing the radius of curvature of the hole as illustrated by phantom 86."

Summarizing, the apparatus of my prior patent, just described as suitable for use in the present invention, comprises a motorized rotational drill powered by mud, commonly called a mud motor, and including a bent casing portion adapted to be connected to a stationary drill string, which portion may be called a stator, and a rotor portion turning a stem or drilling bit or tip connected thereto having three rotary cutters.

Washover pipe 24 extends from a position substantially behind directional drill 20 to the entrance 12 to the drilled hole. Washover pipe 24 is of larger diameter than drill string 22 so that the washover pipe will fit circumferentially around the drill string within the hole. Washover pipe 24 is typically made of ordinary 5" or larger diameter drill pipe. During the drilling along arcuate path 18, a survey tool, of a type well known in the art, is periodically inserted within drill string 22 to a position immediately behind directional drill 20 to determine the current position of the directional drill. This survey tool utilizes magnetic compasses to obtain such readings, and it is necessary for washover pipe 24 to trail directional drill 20 at a sufficient distance, typically at least 100 feet, so that it will not interfere with the operation of the survey tool, usually by drilling the pilot hole for some distance before beginning to insert the washover pipe. Typically washover pipe 24 is not advanced until drill string 22 begins to stick in the hole. Drill string 22 is advanced a desired distance, or until it begins to stick, the advance of drill string 22 is halted while washover pipe 24 is advanced around drill string 22, the leading end of washover pipe 24 remaining some distance behind the leading end of drill string 22 at all times, then the advance of washover pipe 24 is halted while drill string 22 is again advanced until it begins to stick.

At the entrance position 12 of the drilled hole into the ground, an inclined drill rig 26 is positioned in a slanted hole 28. The forward surface 30 of hole 28 is normal to the initial direction of the path into the ground for ease in drilling the hole.

Figure 1A:
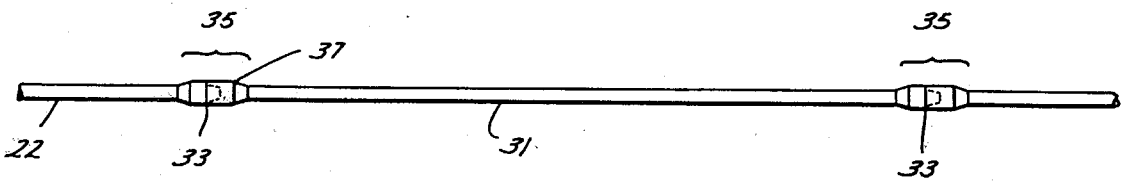
FIG. 1A is an enlarged elevation view of a portion of the drill string illustrated in FIG. 1.

A portion of drill string 22 is illustrated in more detail in FIG. 1A. Each section, such as that numbered 31, of drill string 22 has an upset 37 at each end, making each drill string section of slightly larger, e.g. about $\frac{3}{8}$", external diameter at each end than in the middle. When these sections are joined together drill string 22 is produced with an integral concentric collar 35 at each joint 33 between the sections. This produces a stronger connection at each joint 33 and during the drilling of the pilot hole collars 35 help size the hole and prevent drill string 22 from sticking as frequently.

The leading end of the drilling apparatus illustrated in FIG. 1 is shown in more detail in FIG. 2. Directional drill 20 has a leading drill bit 40 powered by drilling mud supplied through drill string 22. As drill bit 40 dislodges the earth along the desired arcuate path, these cuttings are entrained in the drilling mud which flows backwardly in the small annular space 42 surrounding drill string 22 and into and through annulus 46 between drill string 22 and washover pipe 24. As in the apparatus of the aforementioned U.S. Pat. No. 3,878,903, directional drill 20 may include a bend casing or stator connected at one end to normally stationary drill string 22 and having incorporated in is other end mud powered rotors connected to drill bit 40. Drill string 22 may be turned azimuthally as required to control the direction of the pilot hole.

The leading end of washover pipe 24 is enlarged and provided with cutting blades 45 which enlarge the pilot hole to a diameter greater than that of the washover pipe. For example, if washover pipe 24 is of 5" diameter, cutting blades 45 may enlarge the pilot hole to a $7\frac{1}{2}$" diameter. This produces outer annulus 49 between the enlarged pilot hole and washover pipe 24. During the advance of washover pipe 24 drilling mud is supplied through inner annulus 46 between drill string 22 and washover pipe 24 as shown by arrows 48. The drilling mud entrains the cuttings dislodged by cutting blades 45 and returns them through outer annulus 49 as shown by arrow 50. This prevents the cuttings from accumulating at the leading end of washover pipe 24 and inhibiting its advance.

Figure 2A:
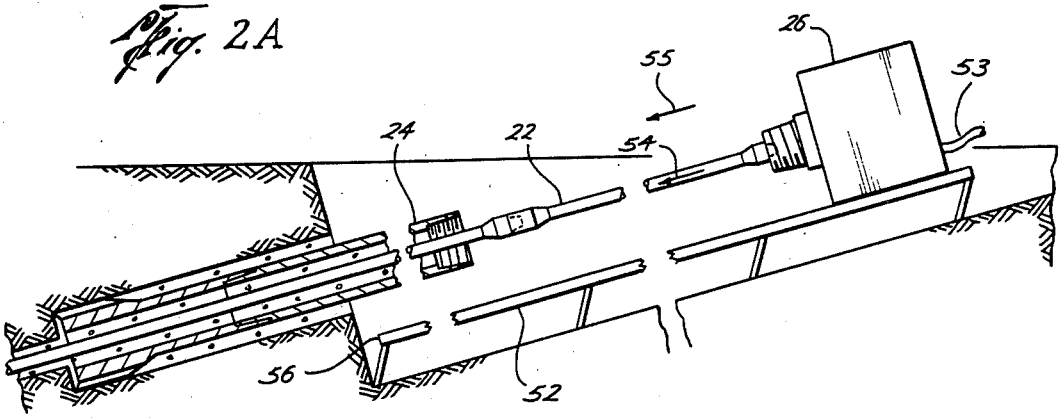
FIG. 2A is a schematic view illustrating one method of advancing the drill string into the hole during the drilling of the pilot hole.

FIG. 2A illustrates in more detail one method of advancing drill string 22. The trailing end of drill string 22 is attached to a chuck on drill rig 26. (One embodiment of a suitable drill rig 26 is described in U.S. Pat. Nos. 4,051,911 and 4,078,617.) Drill rig 26 is advanced down ramp 52 as shown by arrow 55 to crowd drill string 22 into the hole. Drilling mud is pumped through conduit 53, through drill rig 26, and down through drill string 22 as shown by arrow 54. When drill rig 26 reaches lower end 56 of ramp 52, drill rig 26 is drawn back up ramp 52 to the position shown in FIG. 2A. Drill rig 26 is now ready for the attachment of another section of drill string to the trailing end of drill string 22 to again advance the drill string or for the attachment of another section of washover pipe to the trailing end of washover pipe 24 to advance the washover pipe.

Figure 2B:
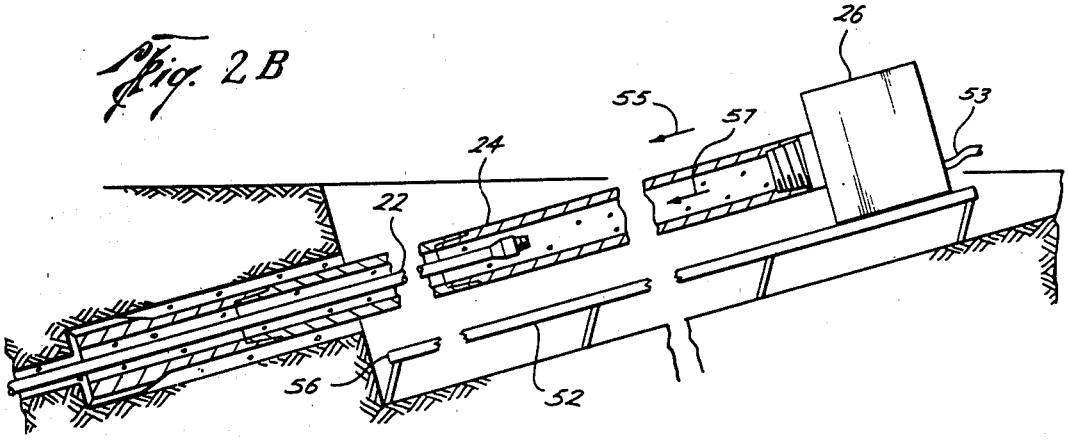
FIG. 2B is a schematic view illustrating one method of advancing the washover pipe into the hole during the drilling of the pilot hole.

FIG. 2B illustrates in more detail one method of advancing washover pipe 24. The trailing end of washover pipe 24 is attached to a chuck on drill rig 26. Drill rid 26 is advanced down ramp 52 as shown by arrow 55 to crowd washover pipe 24 into the hole. Drilling mud is pumped through conduit 53, through drill rig 26, and down through washover pipe 24 as shown by arrow 57. When drill rig 26 reaches lower end 56 of ramp 52, drill rig 26 is drawn back up ramp 52 to the position shown in FIG. 2B. Drill rig 26 is now ready for the attachment of another section of washover pipe to the trailing end of washover pipe 24 to again advance the washover pipe or for the attachment of another section of drill string to the trailing end of drill string 22 to advance the drill string.

Referring again to FIG. 1, when drill string 22 reaches the surface on the other side of water course 10 at point 14, washover pipe 24 is advanced to also exit at point 14. Drill string 22 is withdrawn from the pilot hole, leaving the washover pipe occupying the entire pilot hole from point 12 to point 14.

To prepare for the reaming and installation operation, as is shown by FIG. 3, first reamer 60 is attached to washover pipe 24 where the latter extends out the pilot hole at point 14. Second reamer 66 is attached to the other end of first reamer 60 by a section of washover pipe 64 to provide for some separation between the reamers. Preferably the reamers should be separated a distance of 5 to 15 times the diameter of the reamed hole. For a 36 inch hole, a separation of 30 feet provides good results. Production casing (or conduit or flow pipe) 70 is attached to the other end of second reamer 66 by a swivel 68 to prevent rotation of casing 70 during the reaming and the installation operation. The leading end 69 of casing 70 is closed to prevent the entry of mud and cuttings during the reaming and installation operation. Since the hole sometimes contains water or mud, casing 70 may be weighted to neutralize its buoyancy so that it floats into the hole, facilitating its installation and minimizing any damage to the casing, as described in U.S. Pat. No. 3,894,402.

The remaining length of the first portion of production casing 70 is supported in line with the pilot hole some distance above the ground on rollers 80 and 81 located beyond pilot hole exit point 14. Two rollers are shown, but more may be provided. The first portion of production casing 70 consists of a plurality of casing joints, such as those numbered 83, joined end to end. The first portion of production casing 70 may constitute the entire length of casing to be installed but this may be unwieldy. Hence, it may desirable to provide one or more additional portions of production casing, such as casing portion 82. Casing portion 82 is joined to the trailing end of casing portion 70 after most of casing portion 70 has been installed along reaming path 61. If necessary, additional portions of production casing like casing portion 82 may be fabricated.

Figure 4:
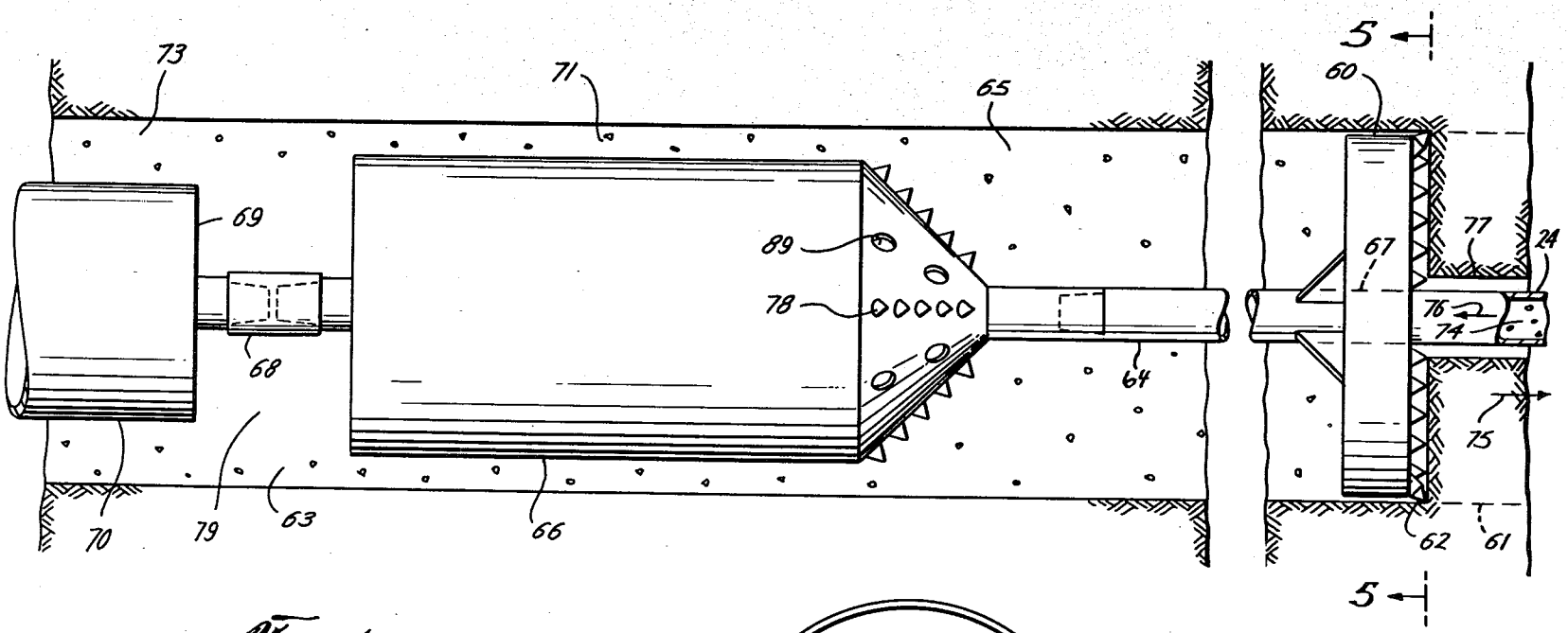
FIG. 4 is an elevation view of the leading end of the reaming apparatus and production casing illustrated in FIG. 3.
Figure 5:
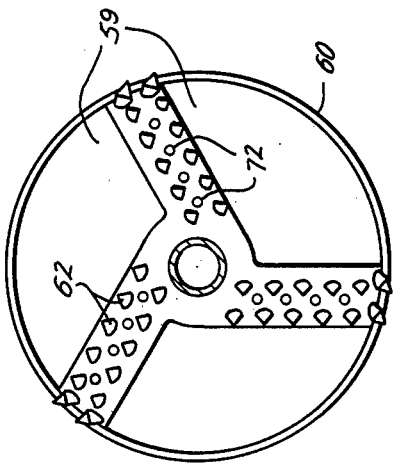
FIG. 5 is a front view of the leading end of the leading reamer illustrated in FIGS. 3 and 4.

The reaming apparatus is shown in more detail in FIGS. 4 and 5. As should be evident from FIG. 4, first reamer 60 is of a larger diameter than second reamer 66. As shown in FIG. 5, first reamer 60 has a plurality of reaming teeth 62, as well as a plurality of ports 72 through which drilling mud exits to entrain the cuttings dislodged by the reamer. Typically first reamer 60 is a flycutter reamer of relatively small length having longitudinal openings 59, as shown in FIG. 5, through which the drilling mud and entrained cuttings may pass into the enlarged hole. As shown in FIG. 4, second reamer 66 has a smaller, typically, leading end provided with reaming teeth 78. Ports 89 are optional and, when provided, provide further exits for drilling mud in addition to ports 72 in first reamer 60. Typically second reamer 66 is a floating reamer of substantially neutral buoyancy in drilling mud weighing approximately 10 pounds per gallon so as to float through the enlarged hole. The trailing end of a second reamer 66 is typically cylindrical and of smaller diameter than first reamer 60 and of larger diameter than production casing 70. For example, first reamer 60 may be of 36" diameter, second reamer 66 of 30" diameter, and production casing 70 of 24" diameter.

The reaming and production casing installation operation proceeds generally as is shown in FIG. 3. Washover pipe 24 is rotated and drawn through the pilot hole in the direction of arrow 75 by drill rig 26. Reamers 60 and 66 are rotated and drawn along reaming path 61 by the rotating washover pipe. Swivel 68 draws production casing 70 along behind second reamer 66 and prevents casing 70 from rotating with the reamers so that the casing is not subjected to the torsional stress which would be caused by rotation. Drilling mud is provided to flow from drill rig 26 through washover pipe 24 and exit at first reamer 60, and, optionally, at second reamer 66.

Sufficient drilling mud must be provided at the reamers to lubricate the advance of production casing 70. If there is too little lubrication, the force which must be exerted on washover pipe 24 in order to draw the reaming apparatus and production casing 70 along drilling path 61 will be so large that washover pipe 24 will knife into the soil and cause the reaming apparatus and production casing 70 to leave drilling path 61. For example, it has been found that the use of a pump supplying 15 barrels of drilling mud a minute to the reamers at a pressure of 900–1100 PSI provides sufficient lubrication to install a 24" production casing.

Typically, the reaming apparatus and production casing are attached to the end of the washover pipe at point 14, but it should be understood that these may be attached to the end of the washover pipe at point 12, in which case the reaming and installation operation would proceed in the direction opposite the one illustrated in FIG. 3. This would, of course, require that drill rig 26, or one like it, be provided at point 14, rather than at point 12, as illustrated in FIG. 3.

The reaming and production casing installation operation is illustrated in more detail by FIG. 4. As the apparatus is rotated and drawn along drilling path 61 in the direction of arrow 75 by washover pipe 24, reaming teeth 62 of first reamer 60 enlarge pilot hole 77 to a diameter greater than that of production casing 70. Drilling mud 74 pumped through washover pipe 24 in the direction of arrow 76 exits through ports 72 in first reamer 60 (shown in FIG. 5) to entrain the cuttings dislodged by reaming teeth 62. The separation provided between first reamer 60 and second reamer 66 by the section of washover pipe 64 permits the cuttings to separate within the drilling mud in space 65 and produces a more accurate hole. Reaming teeth 78 on second reamer 66 further break up and separate the cuttings. Optionally an open passage may be provided through hub 67 of first reamer 60 such that some of the drilling mud 74 continues through hub 67 and section of washover pipe 64 to exit at optional ports 89 in second reamer 66. Second reamer 66, of a smaller diameter than first reamer 60 and a larger diameter than production casing 70, forces the drilling mud and entrained cuttings into annulus 71. The mud and cuttings form a concentric ring 63 around the interior of the enlarged hole while leaving a concentric opening 79 within this ring for passage of the even smaller diameter production casing. Production casing 70, of a smaller diameter than reamers 60 and 66, is drawn into the enlarged hole behind second reamer 66 by swivel 68. Swivel 68 prevents production casing 70 from rotating. The ring 63 of mud and cuttings acts as a bushing in the concentric annulus 73 between production casing 70 and the sides of the enlarged hole to lubricate the advance of production casing 70. Since leading end 69 of casing 70 is closed, the mud and cuttings do not enter the casing.

Referring again to FIG. 3, as non-rotating production casing 70 is drawn along drilling path 61 behind second reamer 66, the length of the first portion of production casing 70 which is outside the hole is drawn along rollers 80 and 81 towards point 14 where the casing enters the hole. The distance between rollers 80 and 81 depends on the strength and characteristics of the production casing. The distance must be short enough that the unsupported part of the production casing 86 which is between rollers 80 and 81 is not subjected to such stress due to its own weight that there is a risk of casing failure. That part of the casing 86 which is between rollers 80 and 81 advances horizontally, and that part of the casing 88 which is between rollers 81 and point 14 bends towards point 14, advancing at downward angle and entering the hole at point 14. The weight of the downward-angled part of the casing 88 which is between rollers 81 and point 14 helps crowd casing 70 into the hole and reduces the force required to draw the casing along reaming path 61. Advancement of casing 70 is further aided by the weight of that part of the casing 90 which is within the hole along the downward-angled portion of reaming path 61.

Using the weight of part of the casing to crowd the casing into hole eliminates the need for powered means to thrust casing 70 into the hole behind the reaming apparatus as in existing methods. Furthermore, since casing 70 bends from its horizontal path along rollers 80 and 81 down to point 14 along the entire length of part 88 of the casing between rollers 81 and point 14, the shear stress on the casing and risk of casing failure are much less than when casing 70 is placed on the ground immediately in front of point 14 and must bend into the hole over a relatively short distance.

When most of the first portion of production casing 70 has been drawn into the hole, the trailing end of casing portion 70 is lifted off of rollers 80 and 81 and onto the ground, casing portion 82 is joined to the trailing end of casing portion 70, the casing is lifted back onto the rollers, and the reaming and installation process continues. Since casing portions 70 and 82 consist of many casing sections, such as those numbered 83, it is unnecessary to frequently interrupt the installation operation in order to join additional casing sections to the trailing end of the casing extending out of the hole.

Figure 6:
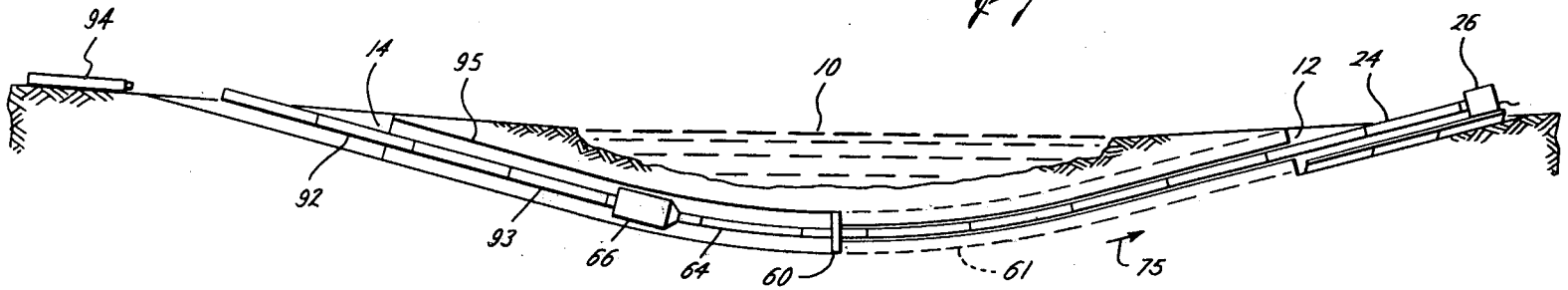
FIG. 6 is a cross-sectional elevation view illustrating an alternate embodiment of the present invention in which the reaming operation proceeds without installing the production casing.

In an alternative embodiment of the invention the reaming operation may be performed without production casing 70 attached to a second reamer 66, followed by a second reaming operation with the production casing attached in order to complete the installation. In the first reaming operation, illustrated by FIG. 6, a section of washover pipe 93 is attached to the trailing end of second reamer 66. As the reaming apparatus and trailing washover pipe is drawn along reaming path 61 additional sections of washover pipe, such as section 94 are joined to the trailing end of washover pipe section 93 to form washover pipe string 92. Sections of the leading washover pipe 24 are removed as they exit the hole at point 12. When the reaming operation is completed and the reaming apparatus reaches point 12, the reaming apparatus is disconnected from washover pipe string 92, transported aboveground to point 14, and attached to the end of washover pipe string 92 where it exits the enlarged hole at point 14. Swivel 68 and production casing 70 are attached to second reamer 66 as described above and shown in FIG. 3. Washover pipe string 92 functions as washover pipe 24 for purposes of the second reaming operation, which includes installation of the production casing and proceeds as described above and illustrated in FIGS. 3 and 4.

It is also possible to use washover pipe string 92 to draw the reaming apparatus back through the enlarged hole from point 12 to point 14 after the initial reaming operation is completed rather than transporting the reaming appparatus aboveground to point 14. As the reaming apparatus is being drawn back through the enlarged hole, the sections of washover pipe 24 which were removed at point 12 during the reaming operation are reattached to the now trailing end of washover pipe 24 at point 12, again providing a washover pipe 24 extending from point 12 to point 14 in enlarged hole 95. Sections of washover pipe string 92 are removed as they exit at point 14 and, when the reaming apparatus reaches point 14, washover pipe section 93 is removed. Swivel 68 and production casing 70 are attached to second reamer 66 and a second reaming operation including installation of the production casing proceeds as described above and illustrated in FIGS. 3 and 4.

Although the foregoing description assumes that drilling mud used in these operations will flow back through the drilled hole to the entrance of the hole, carrying cuttings with it, in many types of formations little or no returns will be obtained. In very porous or uncompacted formations the cuttings and a major portion of the driling mud may be forced into the surrounding formation, building up a tubular bushing around the drill pipe, washover pipe, reamer or casing, as the case may be. In the embodiment of the invention in which the hole is first reamed without the casing, following by a second reaming and pulling the casing through, such a bushing may be formed by the first reaming operation, thereby facilitating the passage of the reamer and casing on the second reaming operations. The lubricity of the drilling mud being pumped through in the second reaming operation will greatly improve the ability to pull the casing through this tubular bushing. The presence of the bushing will help to seal the walls of the hole so as to improve the returns of the drilling mud, thereby providing lubrication of the casing throughout substantially its entire length.

While preferred embodiments of the present invention have been illustrated in detail, modifications and adaptations of these embodiments will occur in those skilled in the art, and many modifications and variations of these embodiments may be made without departing from the spirit of the present invention.

I claim:

1. Apparatus for drilling along an underground inverted path comprising:

a directional drill including an in-hole motor;

a trailing drill string of non-uniform external diameter attached to said directional drill, the largest external diameter of said drill string being less than the diameter of the hole produced by said directional drill, said in-hole motor including a rotor and a stator, said drill including a bit connected to said rotor, one end of said drill string being connected to said stator, said drill string including a plurality of integral external concentric collars disposed at intervals along said drill string, the diameter of each of said collars being less than the diameter of the hole produced by said directional drill, said collars comprising external upsets at the ends of the joints making up said trailing drill string, a drill rig providing means at the other end of said drill string for crowding said drill string into said hole and for azimuthally positioning said drill string in the hole, washover pipe connected at one end to said drill rig and disposed about said drill string and extending from said one end of the drill string toward but separated from said one end of the drill string, leaving an exposed portion of the drill string without said washover pipe, and forming with the covered portion of the drill string therewithin an inner annulus, cutting means connected to the other end of said washover pipe, said drill rig providing means to rotate said washover pipe around said drill string and advance the washover pipe along said path, said washover pipe having an outer diameter larger than said drill bit but smaller than said cutting means whereby to form an outer annulus for drilling mud returns around the washover pipe as it is advanced along said path, said drill rig providing means to deliver drilling mud to said drill string and said inner annulus, fresh drilling mud from the drill rig flowing in said inner annulus forwardly past said collars toward said cutting means providing lubricant between said collars of said covered portion of the drill string and said washover pipe spindled on the drill string and rotating about said collars, detritus laden drilling mud flowing backwards along the path back from the drill bit along the exterior of the exposed portion of the drill string past said collars which help size the hole drilled by said bit along said path by directing the detritus outwardly from the drill string, said collars tending to prevent the exposed portion of said drill string from sticking when it is moved axially along said path without continuous rotation in the hole.

* * * * *

UNITED STATES PATENT AND TRADEMARK OFFICE

CERTIFICATE OF CORRECTION

PATENT NO. : 4,401,170

DATED : August 30, 1983

INVENTOR(S) : Martin D. Charrington

It is certified that error appears in the above—identified patent and that said Letters Patent is hereby corrected as shown below:

Column 1, line 18, change "conduit" to --conduits--.

Column 2, line 67, change "reamer" to --reamers--.

Column 4, line 57, after "desired" insert --path--.

Column 8, line 45, change "rid" to --rig--.

Column 11, line 3, before "downward" insert --a--.

Column 11, line 13, before "hole" insert --the--.

UNITED STATES PATENT AND TRADEMARK OFFICE

CERTIFICATE OF CORRECTION

PATENT NO. : 4,401,170

DATED : August 30, 1983

INVENTOR(S) : Martin D. Cherrington

It is certified that error appears in the above—identified patent and that said Letters Patent is hereby corrected as shown below:

In the Claims

Claim 1

Column 12, line 63, delete "one" and insert --other--.

Signed and Sealed this

Seventh Day of February 1984

[SEAL]

Attest:

GERALD J. MOSSINGHOFF

Attesting Officer

Commissioner of Patents and Trademarks